US011559456B2

(12) United States Patent
Richmond

(10) Patent No.: US 11,559,456 B2
(45) **Date of Patent: *Jan. 24, 2023**

(54) CRANIOSACRAL CRADLE SYSTEM AND METHOD

(71) Applicant: Barbara J. Richmond, Stuart, FL (US)

(72) Inventor: Barbara J. Richmond, Stuart, FL (US)

( * ) Notice: Subject to any disclaimer, the term of this patent is extended or adjusted under 35 U.S.C. 154(b) by 6 days.

This patent is subject to a terminal disclaimer.

(21) Appl. No.: 17/407,352

(22) Filed: Aug. 20, 2021

(65) Prior Publication Data

US 2021/0378899 A1 Dec. 9, 2021

Related U.S. Application Data

(63) Continuation of application No. 15/214,148, filed on Jul. 19, 2016, now Pat. No. 11,129,764, which is a (Continued)

(51) Int. Cl.
*A61G 7/07* (2006.01)
*A61G 13/12* (2006.01)
(Continued)

(52) U.S. Cl.
CPC ..... *A61G 13/121* (2013.01); *A61G 13/123* (2013.01); *A61G 13/1255* (2013.01); *A61H 1/008* (2013.01); *A61H 1/0292* (2013.01); *A61H 1/0296* (2013.01); *A61H 7/001* (2013.01); *A61H 2201/0134* (2013.01); *A61H 2201/1284* (2013.01); *A61H 2201/168* (2013.01)

(58) Field of Classification Search
CPC ..... A61G 13/1205; A61G 13/1255; A61G 13/123; A61G 13/121; A61G 13/12; A61H 1/0296; A61H 1/0292; A61H 1/008; A61H 7/001; A61H 2201/0134; A61H 2201/1284; A61H 2201/168; A61F 5/37; A61F 5/01; A61F 5/00; A47G 9/10; A47G 2008/1018
See application file for complete search history.

(56) References Cited

U.S. PATENT DOCUMENTS 2,336,707 A * 12/1943 Thompson ..... A47C 7/383 5/636
3,694,831 A * 10/1972 Treace ..... A47G 9/10 5/636
(Continued)

*Primary Examiner* — Camtu T Nguyen
(74) *Attorney, Agent, or Firm* — Allen, Dyer, Doppelt + Gilchrist, PA

(57) ABSTRACT

A formed therapeutic tool has a base in a generally heart-shaped configuration with a narrow arcuate front, a wide rear, tapering sides, and a concave bottom. A rearward support is formed of two similarly configured projections. The projections are laterally spaced. Each projection has a linear high point and a semicircular surface. The tool has a forward support formed of two similarly configured inclines. Each incline has an arcuate high point adjacent to one of the projections and an arcuate low point adjacent to the front. A ovoid shaped central recess extends downwardly between the inclines and the projections. The central recess terminates in an ovoid shaped floor with a lower surface constituting a portion of the concave bottom of the base. The tool having a Durometer of from 36 to 45 on a Shore A scale and an Indentation Force Deflection of from 8 to 9.

18 Claims, 13 Drawing Sheets

Related U.S. Application Data continuation-in-part of application No. 13/489,550, filed on Jun. 6, 2012, now abandoned, which is a continuation-in-part of application No. 12/459,895, filed on Jul. 9, 2009, now abandoned.

(51) Int. Cl.

| | |
|---|---|
| ***A61H 1/00*** | (2006.01) |
| ***A61H 7/00*** | (2006.01) |
| ***A61H 1/02*** | (2006.01) |

(56) References Cited

U.S. PATENT DOCUMENTS

| | | | | | |
|---|---|---|---|---|---|
| 4,255,824 | A | | 3/1981 | Pertchik | |
| 4,447,922 | A | | 5/1984 | Brochu | |
| 4,550,458 | A | * | 11/1985 | Fiore | A47G 9/109 5/640 |
| 4,710,991 | A | * | 12/1987 | Wilmore | A61G 15/125 5/636 |
| 4,738,488 | A | * | 4/1988 | Camelio | A47C 7/383 5/636 |
| 5,457,832 | A | | 10/1995 | Tatum | |
| 5,481,771 | A | * | 1/1996 | Burk, IV | A47G 9/10 5/636 |
| 5,682,632 | A | * | 11/1997 | Cotroneo | A61G 13/1215 5/636 |
| 5,933,890 | A | * | 8/1999 | Codd | A47G 9/1009 5/636 |
| 6,006,381 | A | * | 12/1999 | Tandrup | A47D 13/08 5/655 |
| D456,516 | S | * | 4/2002 | Cheshaek | A47G 9/1009 D24/183 |
| 6,751,818 | B2 | * | 6/2004 | Troop | A61G 7/072 5/636 |
| 7,077,141 | B2 | * | 7/2006 | Troop | A61G 7/072 128/202.13 |
| 9,757,303 | B2 | | 9/2017 | Marinkovic | |
| 11,129,764 | B2 | * | 9/2021 | Richmond | A61G 13/1255 |
| 2009/0307846 | A1 | | 12/2009 | Eura et al. | |
| 2016/0066707 | A1 | | 3/2016 | Telford et al. | |

* cited by examiner

CRANIOSACRAL CRADLE SYSTEM AND METHOD

RELATED APPLICATION

The present application is a continuation of pending application Ser. No. 15/214,148 filed Jul. 19, 2016, which is a continuation-in-part of application Ser. No. 13/489,550 filed Jun. 6, 2012, which is a continuation-in-part of application Ser. No. 12/459,395 filed Jul. 9, 2009, the entire subject matter of these applications is incorporated herein by reference.

BACKGROUND OF THE INVENTION

Field of the Invention

The present invention relates to a craniosacral cradle system and more particularly pertains to supporting a supine patient selectively at the patient's head, neck, shoulders, body and sacrum during rest and during craniosacral, massage, and manual therapy, the supporting being done in a safe, effective and economical manner.

Description of the Prior Art

The present invention is a craniocradle which relates to craniosacral, massage and osteopathy techniques which are manual therapies used to relieve pain and dysfunction. The craniocradle is a tool based upon hands-on techniques from these manual methods of pain relief. Therefore, it provides the user multiple ways to use it under the body to encourage joints to decompress and cramped tense muscles to gently release. The design incorporates positions of actual trained therapy hands as they are used under the body, where the hands ease tight tense muscles and relieve nagging aches, pains and fatigue. In certain specific hand techniques, trained therapists use their hands in a co-joined manner and they also use their fingers to provide direct contact into tight painful muscles. The craniocradle design incorporated both the co-joined hands and the fingers techniques so that it can be used instead of a manual therapist. The craniocradle is used to ease muscle aches and pains and to promote a deep relaxation.

The use of cranial/sacral support systems of known designs and configurations is known in the prior art. More specifically, cranial/sacral support systems of known designs and configurations previously devised and utilized for the purpose of supporting a patient during therapy are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, they do not describe a craniosacral cradle system and method that allows supporting a supine patient selectively at the patient's head, neck, shoulders, body and sacrum during rest and during craniosacral, massage, and manual therapy, the supporting being done in a safe, effective and economical manner.

In this respect, the craniosacral cradle system and method according to the present invention substantially departs from the conventional concepts and designs of the prior art, and in doing so provides an apparatus primarily developed for the purpose of supporting a supine patient selectively at the patient's head, neck, shoulders, body and sacrum during rest and during craniosacral therapy, the supporting being done in a safe, effective and economical manner.

Therefore, it can be appreciated that there exists a continuing need for a new and improved craniosacral cradle system and method which can be used for supporting a supine patient selectively at the patient's head, neck, shoulders, body and sacrum during rest and during craniosacral therapy, the supporting being done in a safe, effective and economical manner. In this regard, the present invention substantially fulfills this need.

SUMMARY OF THE INVENTION

In view of the foregoing disadvantages inherent in the known types of cranial/sacral support systems of known designs and configurations now present in the prior art, the present invention provides an improved craniosacral cradle system and method. As such, the general purpose of the present invention, which will be described subsequently in greater detail, is to provide a new and improved craniosacral cradle system and method and method which has all the advantages of the prior art and none of the disadvantages.

To attain this, the present invention essentially comprises respect to each other so as to attain the desired objective. The craniosacral cradle system is supporting a supine patient selectively at the patient's head, neck, shoulders, body and sacrum during rest and during craniosacral therapy. First provided is a therapeutic tool fabricated from a chemical process creating a one piece block of integral skin polyurethane foam which is washable and disinfectable. The therapeutic tool has calculated compression and resilience. In the preferred embodiment, the therapeutic tool has a Durometer of from 36 to 45 on a Shore A scale and an Indentation Force Deflection of from 8 to 9.

The therapeutic tool has a base in a generally heart-shaped configuration with a narrow arcuate front and a wide rear and tapering sides between the front and the rear. The base has a concave bottom adapted to be supported on a recipient horizontal surface. The therapeutic tool has a maximum width adjacent to the rear of 6.0 inches plus or minus 10 percent. The therapeutic tool has a maximum length midway between the sides of 4.38 inches plus or minus 10 percent. The therapeutic tool has a maximum height of 2.75 inches plus or minus 10 percent.

The therapeutic tool has a rearward support formed of two similarly configured projections. The projections are laterally spaced from adjacent to the rear with a V-shaped recess between the projections. Each of the projections has a linear high point. The high point extends from adjacent to the rear to a The semicircular location nearly half the length of the therapeutic tool. Each of the projections has a semicircular surface. The semicircular surface is between the sides. The therapeutic tool has a forward support formed of two similarly configured inclines. Each of the inclines has an arcuate high point adjacent to one of the projections. Each of the inclines has an arcuate low point adjacent to the front. Each of the inclines has a semicircular surface between the sides.

The therapeutic tool has an ovoid shaped central recess extending downwardly between the inclines and between the projections. The central recess terminates below in an ovoid shaped floor with a lower surface constituting a portion of the concave bottom of the base. The floor has a thickness over the majority of its extent of 20 percent of the height plus or minus 10 percent with an upwardly extending lip at the front.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved craniosacral cradle system and method which has all of the advantages of the prior art cranial/sacral support systems of known designs and configurations and none of the disadvantages. It is another object of the present invention to provide a new and improved craniosacral cradle system which may be easily and efficiently manufactured and marketed.

It is a further object of the present invention to provide a new and improved craniosacral cradle system which is of durable and reliable constructions.

An even further object of the present invention is to provide a new and improved craniosacral cradle system which is susceptible of a low cost of manufacture with regard to both materials and labor, and which accordingly is then susceptible of low prices of sale to the consuming public, thereby making such craniosacral cradle system economically available to the buying public.

Even still another object of the present invention is to provide a craniosacral cradle system for supporting a supine patient selectively at the patient's head, neck, shoulders, body and sacrum during rest and during craniosacral therapy, the supporting being done in a safe, effective and economical manner. Lastly, it is an object of the present invention to provide a new and improved craniocradle system having a formed therapeutic tool with a base in a generally heart-shaped configuration with a narrow arcuate front, a wide rear, tapering sides, and a concave bottom. The therapeutic tool has a rearward support formed of two similarly configured projections. The projections are laterally spaced from adjacent to the rear. Each projection has a linear high point and has a semicircular surface between the sides. The therapeutic tool has a forward support formed of two similarly configured inclines. Each of the inclines has an arcuate high point adjacent to one of the projections and an arcuate low point adjacent to the front. The therapeutic tool has an ovoid shaped central recess extending downwardly between the inclines and between the projections. The central recess terminates in an ovoid shaped floor with a lower surface constituting a portion of the concave bottom of the base. These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OP THE PREFERRED EMBODIMENT

Figure 1:
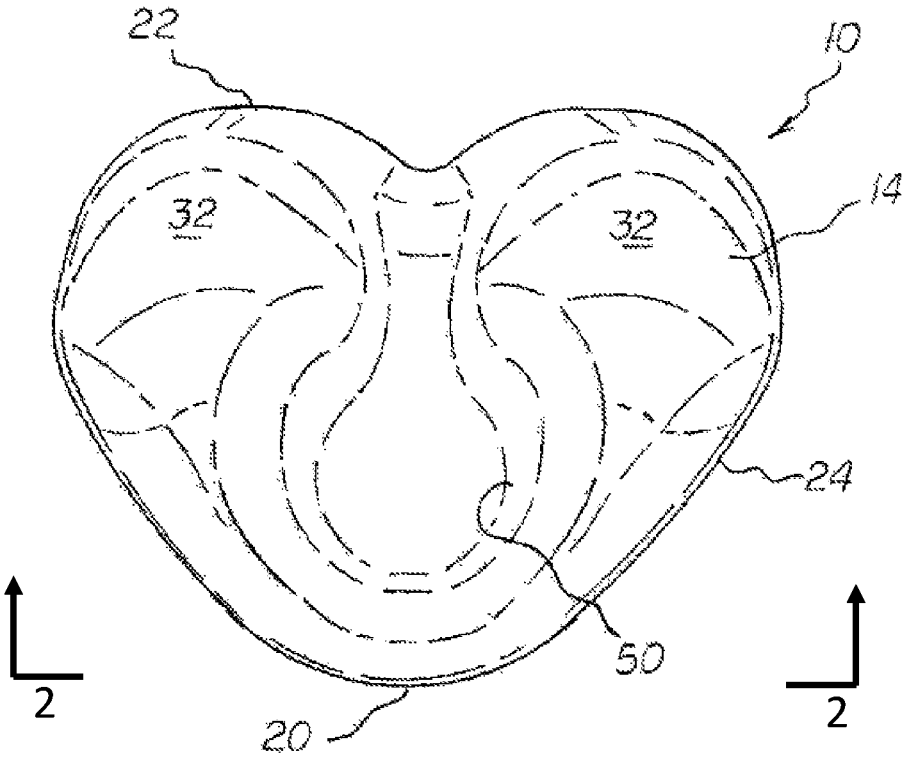
FIG. 1 is a plan view of a craniocradle system constructed in accordance with the principles of the present invention.

With reference now to the drawings, and in particular to FIG. 1 thereof, the preferred embodiment of the new and improved craniosacral cradle system embodying the principles and concepts of the present invention and generally designated by the reference numeral 10 will be described.

The present invention, the craniosacral cradle system 10 is comprised of a plurality of components. Such components in their broadest context include a formed therapeutic tool with a base, a rearward support, a forward support, and an ovoid shaped central recess. Such components are individually configured and correlated with respect to each other so as to attain the desired objective.

The craniosacral cradle system 10 is supporting a supine patient selectively at the patient's head, neck and sacrum during rest and during craniosacral therapy. First provided is a formed therapeutic tool 14 fabricated from a chemical process creating a one piece block of integral skin polyurethane foam which is washable and disinfectable. The therapeutic tool has calculated compression and resilience. In the preferred embodiment, the therapeutic tool has a Durometer of from 36 to 45 on a Shore A scale and an Indentation Force Deflection of from 8 to 9.

The therapeutic tool has a base 18 in a generally heart-shaped configuration with a narrow arcuate front 20 and a wide rear 22 and tapering sides 24 between the front and the rear. The base has a concave bottom 26 adapted to be supported on a recipient horizontal surface. The therapeutic tool has a maximum width adjacent to the rear of 6.0 inches plus or minus 10 percent. The therapeutic tool has a maximum length midway between the sides of 4.38 inches plus or minus 10 percent. The therapeutic tool has a maximum height of 2.75 inches plus or minus 10 percent.

Figure 2:
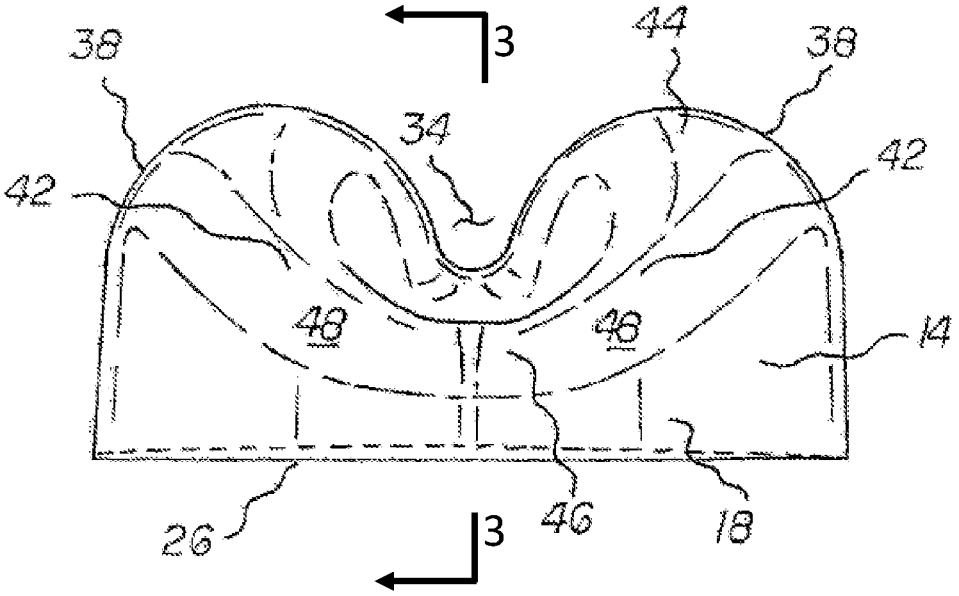
FIG. 2 is a front elevational view of the system taken along line 2-2 of FIG. 1.
Figure 3:
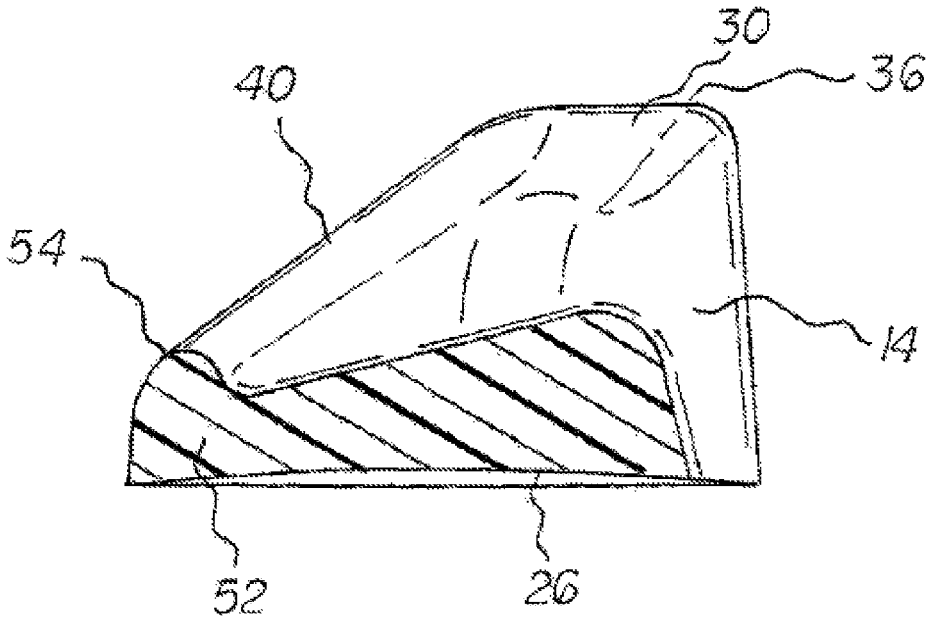
FIG. 3 is a cross sectional view of the system taken along line 3-3 of FIG. 2.

The therapeutic tool has a rearward support 30 formed of two similarly configured projections 32. The projections are laterally spaced from adjacent to the rear with a V-shaped recess 34 between the projections. Each of the projections has a linear high point 36. Note FIG. 3. The high point extends from adjacent to the rear to a location nearly half the length of the therapeutic tool. Each of the projections has a semicircular surface 38. Note FIG. 2. The semicircular surface is between the sides.

The therapeutic tool has a forward support 40 formed of two similarly configured inclines 42. Each of the inclines has an arcuate high point 44 adjacent to one of the projections. Each of the inclines has an arcuate low point 46 adjacent to the front. Each of the inclines has a semicircular surface 48 between the sides.

The therapeutic tool has an ovoid shaped central recess 50 extending downwardly between the inclines and between the projections. The central recess terminates below in an ovoid shaped floor 52 with a lower surface constituting a portion of the concave bottom of the base. The floor has a thickness over the majority of its extent of 20 percent of the height plus or minus 10 percent with an upwardly extending lip 54 at the front.

Figure 4:
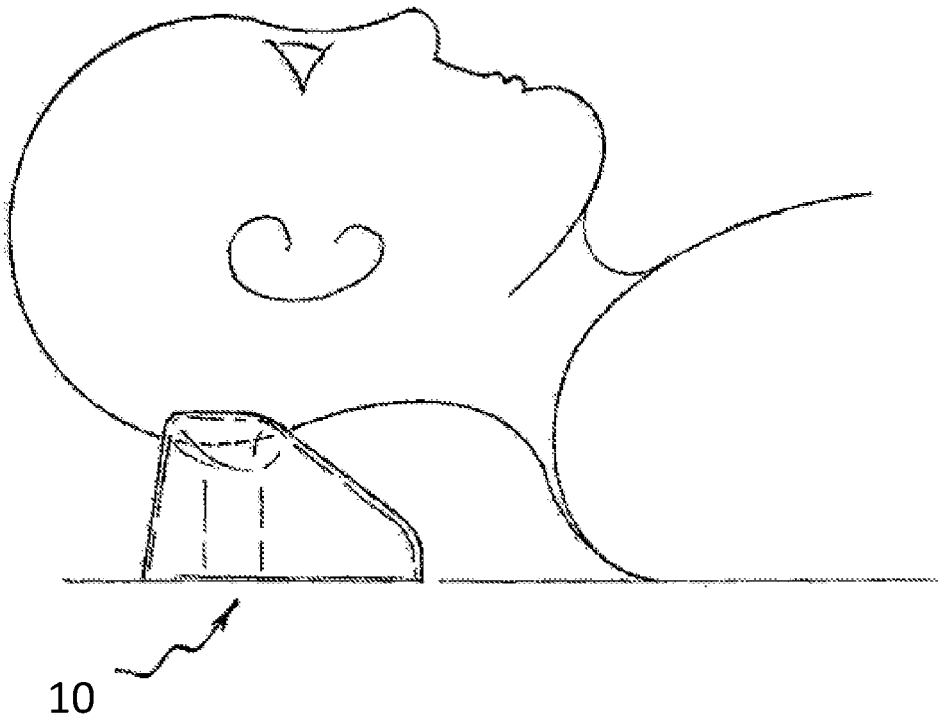
FIG. 4 is a side elevational view of an application based on a craniosacral therapy technique with the craniocradle supporting the back of the head just above the occipital ridge and with the head resting on the top surface areas, the craniocradle causing pressure to momentarily halt the movement of cerebral spinal fluid whereby as the fluid builds and releases, it is believed to promote deep calming and relaxation and eases stress, anxiety and tension and also eases headaches.

The system is positionable in a wide variety of positions as may be seen in the various Figures. FIG. 4 is a side elevational view of an application based on a craniosacral therapy technique with the craniocradle supporting the back of the head just above the occipital ridge and with the head resting on the top surface areas. The craniocradle causes pressure to momentarily halt the movement of cerebral spinal fluid whereby as the fluid builds and releases. It is believed to promote deep calming and relaxation and eases stress, anxiety and tension and also eases headaches.

Figure 5:
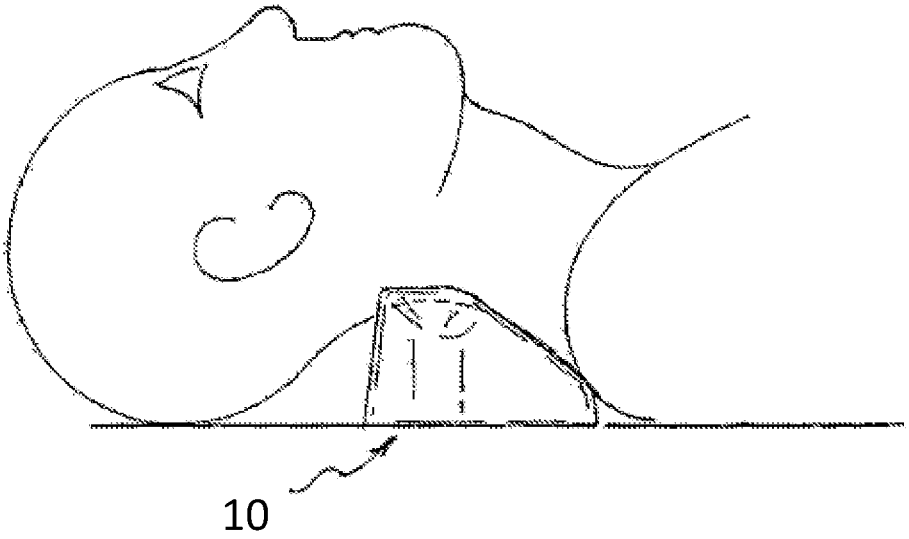
FIG. 5 is a side elevational view of an application based on massage therapy techniques wherein the finger arches or ridge are positioned underneath the occipital ridge to provide direct pressure to the thick musculature located there, the direct pressure easing muscle tension which helps ease headache pain caused by muscle tension.

FIG. 5 is a side elevational view of an application based on massage therapy techniques wherein the finger arches or ridge are positioned underneath the occipital ridge to provide direct pressure to the thick musculature located there. The direct pressure easing muscle tension helps ease headache pain caused by muscle tension.

Figure 6:
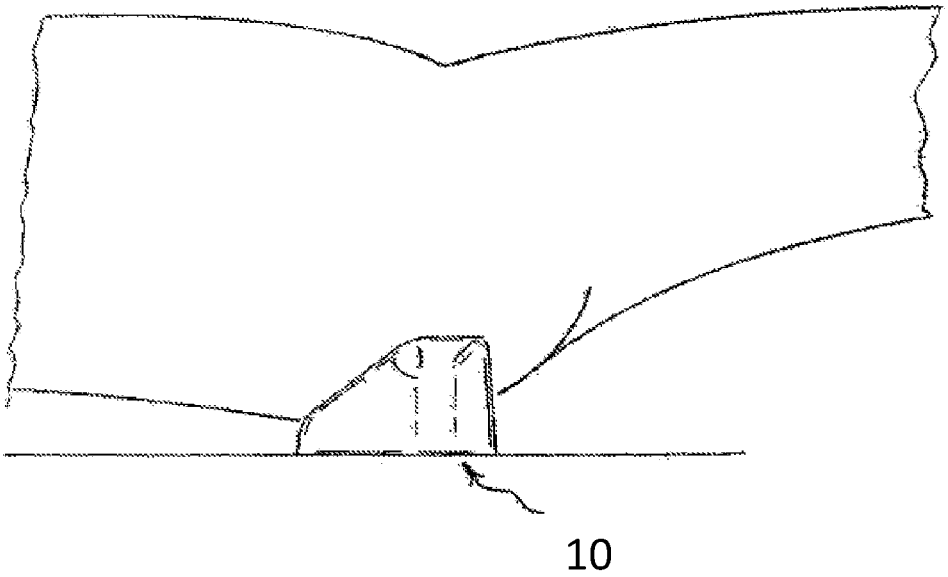
FIG. 6 is a side elevational view of an application based on a craniosacral therapy technique with the craniocradle being positioned at the low end of the sacrum, the coccyx being occupied in the ovoid valley and the finger arches/ridges being into the trigger points at the sacrum and which helps to ease low back aches and ease muscle tension.

FIG. 6 is a side elevational view of an application based on a craniosacral therapy technique. The craniocradle is positioned at the low end of the sacrum, the coccyx being occupied in the ovoid valley and the finger arches/ridges being into the trigger points at the sacrum. This helps to ease low back aches and ease muscle tension.

Figure 7:
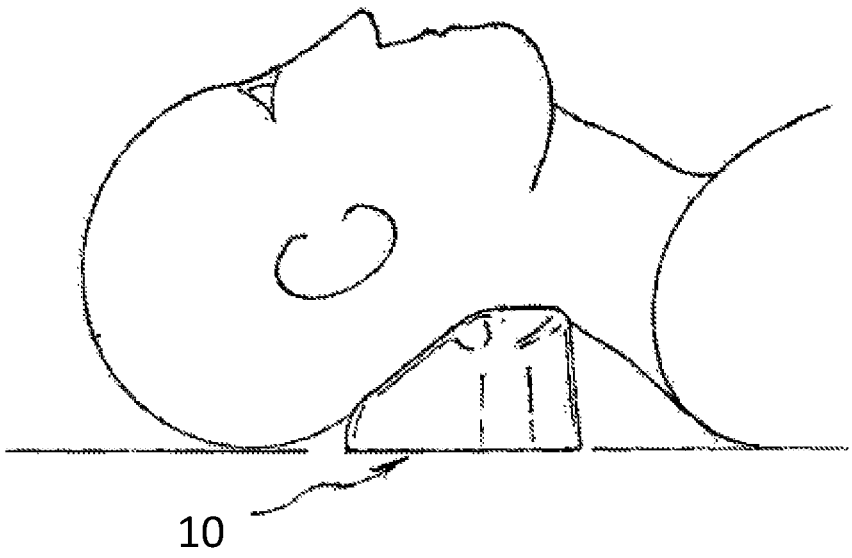
FIG. 7 is a side elevational view of an application based on helping re-establish the c-curve of the cervical spine, the occipital base of the head resting on the top surfaces and the top of the head supported on the front slopes, use relaxes tight tension muscles of the face, jaw, neck and shoulders, and helps ease symptoms of whiplash, TMJ, Bruxism and also helps release tension in the neck and shoulders.

FIG. 7 is a side elevational view of an application based on helping re-establish the c-curve of the cervical spine. The occipital base of the head rests on the top surfaces and the top of the head supported on the front slopes. This application relaxes tight tension muscles of the face, jaw, neck and shoulders. It helps ease symptoms of whiplash, TMJ, Bruxism and also helps release tension in the neck and shoulders.

Figure 8:
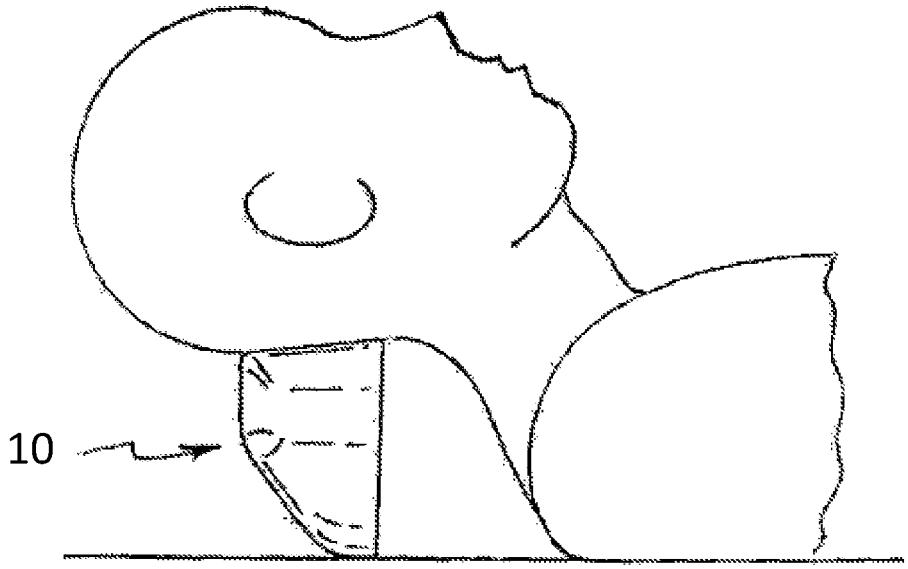
FIG. 8 is a side elevational view of an application based on massage therapy techniques to stretch the neck, the craniocradle having back slopes placed under the occipital base supporting the neck in an elevated position, the weight of the head holding the craniocradle stable so that it moves, side-to-side, stretching the muscles attached at the base of the head and neck.

FIG. 8 is a side elevational view of an application based on massage therapy techniques to stretch the neck. The craniocradle has back slopes placed under the occipital base supporting the neck in an elevated position. The weight of the head holds the craniocradle stable so that it moves, side-to-side, stretching the muscles attached at the base of the head and neck.

Figure 9:
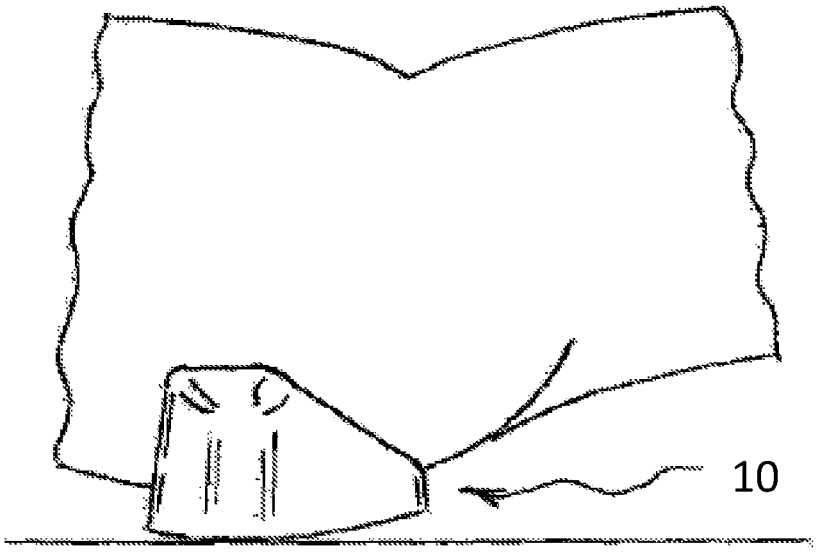
FIG. 9 is a side elevational view of an application based upon massage therapy wherein the craniocradle is placed under the body with the finger arches in between the SI joint at the top of the sacrum which helps ease low back tension.

FIG. 9 is a side elevational view of an application based upon massage therapy. The craniocradle is placed under the body with the finger arches in between the SI joint at the top of the sacrum which helps ease low back tension.

Figure 10:
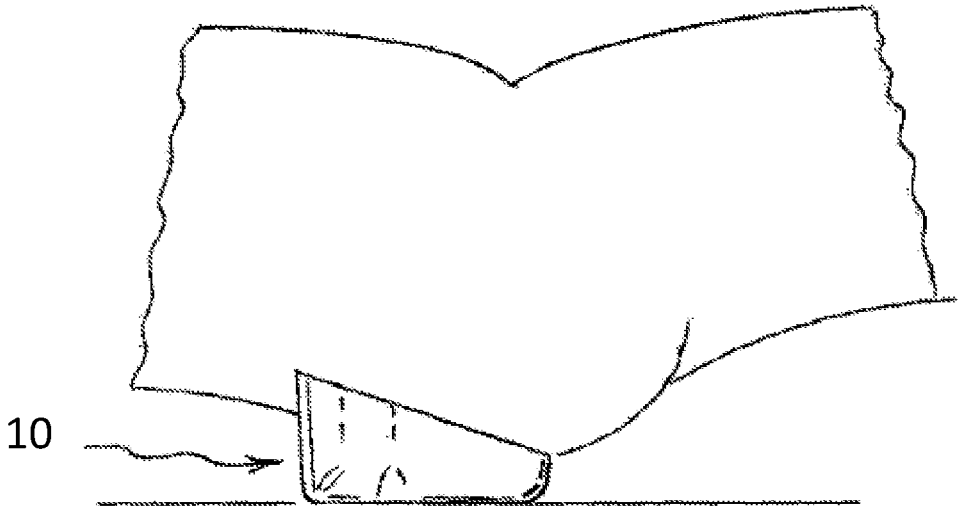
FIG. 10 is a side elevational view of an application based on massage therapy wherein the craniocradle is placed under the body with the finger arches facing away from the SI joint at the top of the sacrum which helps ease low back tension.

FIG. 10 is a side elevational view of an application based on massage therapy wherein the craniocradle is placed under the body. The finger arches face away from the SI joint at the top of the sacrum which helps ease low back tension.

Figure 11:
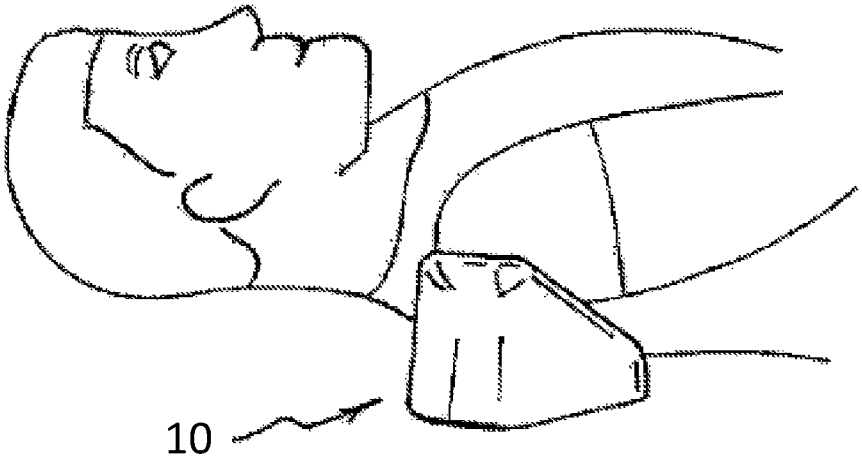
FIG. 11 is a side elevational view of an application based on massage therapy wherein the craniocradle finger arches are used to release trigger points in the shoulder area with the spinal cord resting in the middle of the ovoid valley which eases trigger points, and wherein te craniocradle may be moved anywhere under the body to release trigger points.

FIG. 11 is a side elevational view of an application based on massage therapy wherein the craniocradle finger arches are used to release trigger points in the shoulder area with the spinal cord resting in the middle of the ovoid valley which eases trigger points. The craniocradle may be moved anywhere under the body to release trigger points.

Figure 12:
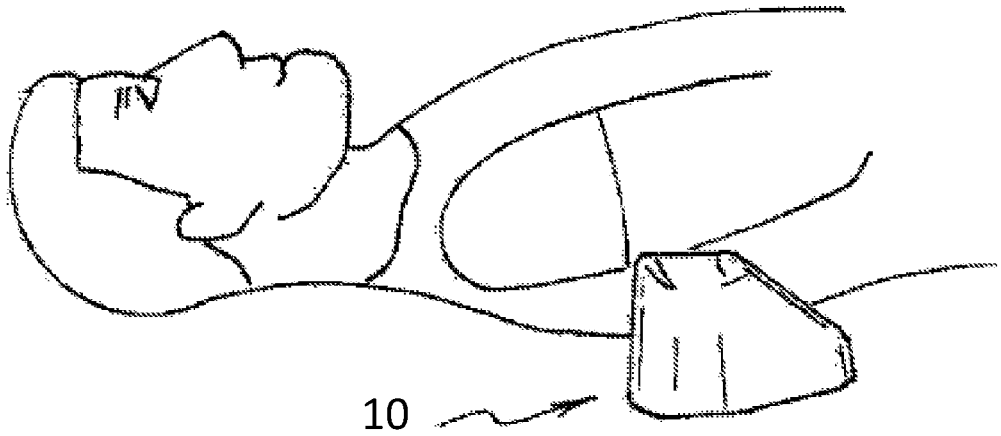
FIG. 12 is a side elevational view of an application based on massage therapy wherein the craniocradle finger arches are used under the thoracic area with the spinal cord resting in the middle of the ovoid valley which helps to open and stretch the chest area.

FIG. 12 is a side elevational view of an application based on massage therapy wherein the craniocradle finger arches are used under the thoracic area. The spinal cord rests in the middle of the ovoid valley which helps to open and stretch the chest area.

Figure 13:
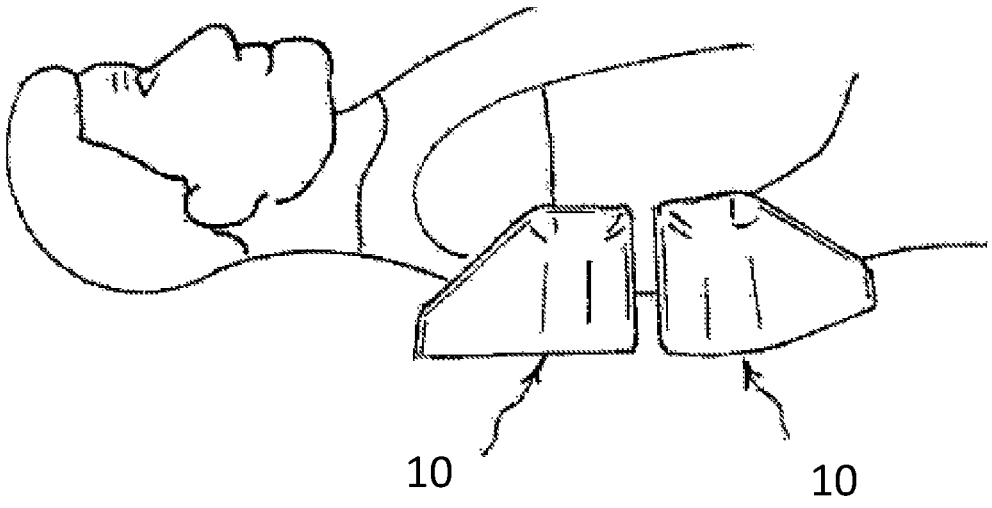
FIG. 13 is a side elevational view of an application based on massage therapy wherein two craniocradle's are used back to back, to form a bridge underneath the body reach fingers and toes out in opposite directions which helps to stretch the spinal vertebras. The same reference numerals refer to the same parts throughout the various Figures.

FIG. 13 is a side elevational view of an application based on massage therapy. Two craniocradle's are used back to back, to form a bridge underneath the body reach fingers and toes out in opposite directions which helps to stretch the spinal vertebras. The system is a self-help therapeutic device used for improving health, wellness and vitality.

An individual lies supine and places the craniocradle underneath the body. The craniocradle can be placed underneath the head, underneath the neck, and/or underneath the sacrum. Rest in position for 2 to 5 minutes with the cradle at each location. Proper placement of the craniocradle mimics the hands-on techniques of CranioSacral Therapy.

CranioSacral Therapy (CST) is a gentle, hands-on method of evaluating and enhancing the functioning of a physiological body system called the craniosacral system—comprised of the membranes and cerebrospinal fluid that surround and protect the brain and spinal cord.

Using a soft touch generally no greater than 5 grams, or about the weight of a nickel, practitioners release restrictions in the craniosacral system to improve the functioning of the central nervous system.

By complementing the body's natural healing processes, CST is increasingly used as a preventive health measure for its ability to bolster resistance to disease, and is effective for a wide range of medical problems associated with pain and dysfunction, including: Migraine Headaches, Chronic Neck and Back Pain, Motor-Coordination Impairments, Colic, Autism, Central Nervous System Disorders, Orthopedic Problems, Traumatic Brain and Spinal Cord Injuries, Scoliosis, Infantile Disorders, Learning Disabilities, Chronic Fatigue, Emotional Difficulties, Stress and Tension-Related Problems, Fibromyalgia and other Connective-Tissue Disorders, Temporomandibular Joint Syndrome (TMJ), Neurovascular or Immune Disorders, Post-Traumatic Stress Disorder, Post-Surgical Dysfunction.

CST employs a 10-step treatment protocol, that is, there are ten areas of the body where a CS therapist uses hands-on techniques. Specifically positioning the craniocradle duplicates 3 hands-on CST techniques. They are: Still-Point Induction as shown in FIG. 4; Occipital Cranial Base Release as shown in FIG. 5; and Still-point Induction through the Sacrum as shown in FIG. 6.

Still-Point Induction: In a supine position, place the craniocradle underneath the head, positioning the tops of the rounded areas directly under the area just above the bony ridges (occiput) of the skull with the point of the V pointing to the toes. Rest comfortably for approximately 10 minutes. The movement of the cerebrospinal fluid (CSF) will come to a gradual therapeutic stop or still-point. The craniosacral system is a semi-closed hydraulic system so the CSF builds and then releases allowing the whole body to self-correct and relax.

Occipital Cranial Base Release: In a supine position, place the craniocradle underneath the head, positioning the curve of the vertical peaks at the juncture of the neck and skull, the area called the occipital base with the point of the V pointing to the toes. Rest comfortably for 1-5 minutes. The muscles of the occipital base will slowly relax and as this happens the head will gently drop and come to rest on the resting surface. The relaxation of these muscles facilitates movement of the CSF within the dural tube.

Still-point Induction through the Sacrum: In a supine position, place the craniocradle underneath the sacrum area with the point of the V pointing towards the head. Position the craniocradle so that is cradles the posterior sacrum. Rest comfortably for approximately 10 minutes. The movement of the cerebrospinal fluid (CSF) will come to a gradual therapeutic stop or still-point. The craniosacral system is a semi-closed hydraulic system so the CSF builds and then releases allowing the whole body to self-correct and relax. The craniocradle can be used in the order described above but it is not mandatory. Individuals will be able to use the craniocradle in any placement order as well as using it for one area instead of two or three.

Many people store tension in the lower neck and shoulder area. These areas feel tight/hard to the touch and are often occupied by spots or areas that feel tender when palpated. Use of the craniocradle can help relieve the tightness/soreness by easing the tension in these areas.

To release the tension in the lower neck/upper shoulder area, lie supine on a flat surface and place the craniocradle, point toward the toes, underneath the top of the shoulder area. Rest comfortably for 5 to 10 minutes.

To release the tension between the shoulder blades, lie supine on a flat surface and place the craniocradle, point toward the toes, between the shoulder blades. Rest comfortably for 5 to 10 minutes.

The present invention also includes a craniosacral cradle method for supporting a supine patient selectively at the patient's head, neck, shoulders, body and sacrum during rest and during craniosacral, massage, and manual therapy. The method comprises, in combination, a plurality of steps.

The first step is providing a formed therapeutic tool fabricated from a chemical process creating a one piece block of integral skin polyurethane foam which is washable and disinfectable. The therapeutic tool has calculated compression and resilience. In the preferred embodiment, the therapeutic tool has a Durometer of from 36 to 45 on a Shore A scale and an Indentation Force Deflection of from 8 to 9.

The therapeutic tool has a non-rocking base in a generally heart-shaped configuration with a narrow arcuate front and a wide rear and tapering sides between the front and the rear. The base has a concave bottom supported on a horizontal recipient surface (20) in a non-rocking first position. The therapeutic tool has a maximum width adjacent to the rear of 6.0 inches plus or minus 10 percent. The therapeutic tool has a maximum length midway between the sides of 4.38 inches plus or minus 10 percent. The therapeutic tool has a maximum height of 2.75 inches plus or minus 10 percent.

The therapeutic tool has a rearward non-rocking support (40) formed of two similarly configured projections laterally spaced from adjacent to the rear with a V-shaped recess between the projections. Each of the projections has a linear high point extending from adjacent to the rear to a location nearly half the length of the therapeutic tool. Each of the projections has a semicircular surface between the sides. The two similarly configured projections are supported on the horizontal recipient surface in a non-rocking second position.

The therapeutic tool has a forward rocking support formed of two similarly configured inclines. Each of the inclines has an arcuate high point adjacent to one of the projections. Each of the inclines has an arcuate low point adjacent to the front. Each of the inclines has a semicircular surface (20) between the sides. The semi-circular surface is supported on the horizontal recipient surface in a side to side rocking third position.

The therapeutic tool has an ovoid shaped central recess extending downwardly between the inclines and between the projections. The central recess terminates below in an ovoid shaped floor with a lower surface constituting a portion of the concave bottom of the base. The floor has a thickness over the majority of its extent of 20 percent of the height plus or minus 10 percent with an upwardly extending lip at the front.

The next step is positioning the system in the first position with the bottom of the system positioned on the horizontal recipient surface; 10 percent with an upwardly extending lip at the front; 10 percent with an upwardly extending lip at the front.

The next step is positioning the system in the second position with the top of the craniocradle positioned on the horizontal recipient surface; 10 percent with an upwardly extending lip at the front.

The next step is positioning the system in the third position with the front of the craniocradle rockingly supported on the horizontal recipient surface.

The method also includes the step of providing a second therapeutic tool configured identical to the first mentioned therapeutic tool and concurrently positioning both the first mentioned therapeutic tool and the second therapeutic tool beneath the patient for the concurrent treatment of a single malady.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A support device for supporting a patient, the support device comprising:

a rear end;

a front end opposite the rear end and having a width less than the rear end;

first and second longitudinal sides extending between the rear end and the front end, the first and second longitudinal sides tapering from the rear end to the front end, the rear end comprising a first semi-circle shaped side, a second semi-circle shaped side, and a medial side between the first semi-circle shaped side and the second semi-circle shaped side, the medial side extending inwardly from the first semi-circle shaped side and the second semi-circle shaped side to define a V-shaped recess therebetween;

the front end comprising an arcuate side, the arcuate side comprising first and second arcuate ends respectively extending into the first and second longitudinal sides;

a first projection;

a second projection, the V-shaped recess extending between the first projection and the second projection;

an ovoid-shaped central recess declining towards the front end and between the first and second projections;

the first semi-circle shaped side and the second semi-circle shaped side being boundaries respectively for the first projection and the second projection; and an upwardly extending lip at the front end and being a boundary for the ovoid-shaped central recess, the support device comprising a foam material and to provide a craniosacral cradle support for the patient in a supine position.

2. The support device of claim 1 wherein the foam material has a Shore durometer between 36 and 45.

3. The support device of claim 1 wherein the foam material has an Indentation Force Deflection between 8 and 9.

4. The support device of claim 1 wherein the first projection and the second projection each comprises a rearward support at the rear end, and a forward support extending from the rearward support to the upwardly extending lip.

5. The support device of claim 1 wherein the upwardly extending lip comprises a curved upper surface.

6. The support device of claim 1 wherein the front end, the rear end, the first and second projections, and the upwardly extending lip are integral with each other.

7. The support device of claim 1 wherein each the first and second longitudinal sides comprises an incline extending from the front end to the rear end.

8. The support device of claim 7 wherein the incline has an arcuate high point adjacent to one of the first and second projections.

9. The support device of claim 1 wherein the foam material comprises polyurethane foam.

10. A method for supporting a patient with a support device comprising a rear end, a front end opposite the rear end and having a width less than the rear end, first and second longitudinal sides extending between the rear end and the front end, the first and second longitudinal sides tapering from the rear end to the front end, the rear end comprising a first semi-circle shaped side, a second semi-circle shaped side, and a medial side between the first semi-circle shaped side and the second semi-circle shaped side, the medial side extending inwardly from the first semi-circle shaped side and the second semi-circle shaped side to define a V-shaped recess therebetween, the front end comprising an arcuate side, the arcuate side comprising first and second arcuate ends respectively extending into the first and second longitudinal sides, a first projection, a second projection, the V-shaped recess extending between the first projection and the second projection, an ovoid-shaped central recess declining towards the front end and between the first and second projections, the first semi-circle shaped side and the second semi-circle shaped side being boundaries respectively for the first projection and the second projection, and an upwardly extending lip at the front end and being a boundary for the ovoid-shaped central recess, the support device comprising a foam material, the method comprising:

positioning the support device on a horizontal recipient surface to provide a craniosacral cradle support for the patient in a supine position; and supporting one of a head, a neck, a shoulder, a body and a sacrum of the patient during therapy.

11. The method of claim 10 wherein the first projection and the second projection each comprises a rearward support at the rear end, and a forward support extending from the rearward support to the upwardly extending lip.

12. The method of claim 10 wherein the upwardly extending lip comprises a curved upper surface.

13. The method of claim 10 wherein the front end, the rear end, the first and second projections, and the upwardly extending lip are integral with each other.

14. The method of claim 10 wherein each the first and second longitudinal sides comprises an incline extending from the front end to the rear end.

15. The method of claim 14 wherein the incline has an arcuate high point adjacent to one of the first and second projections.

16. The method of claim 10 wherein the foam material comprises polyurethane foam.

17. The method of claim 10 wherein the foam material has a Shore durometer between 36 and 45.

18. The method of claim 10 wherein the foam material has an Indentation Force Deflection between 8 and 9.

* * * * *